US009745128B2

(12) United States Patent
Romano et al.

(10) Patent No.: US 9,745,128 B2
(45) Date of Patent: Aug. 29, 2017

(54) TRASH CONTAINER

(71) Applicants: Robert Romano, Levittown, NY (US); Robert J. Guarino, Lindenhurst, NY (US)

(72) Inventors: Robert Romano, Levittown, NY (US); Robert J. Guarino, Lindenhurst, NY (US)

( * ) Notice: Subject to any disclaimer, the term of this patent is extended or adjusted under 35 U.S.C. 154(b) by 45 days.

(21) Appl. No.: 14/815,539

(22) Filed: Jul. 31, 2015

(65) Prior Publication Data

US 2016/0194150 A1 Jul. 7, 2016

(51) Int. Cl.

| | |
|---|---|
| ***B65F 1/00*** | (2006.01) |
| ***B65F 1/06*** | (2006.01) |
| *B65F 1/16* | (2006.01) |

(52) U.S. Cl.

CPC ..... *B65F 1/068* (2013.01); *B65F 1/062* (2013.01); *B65F 1/163* (2013.01); *Y10S 220/908* (2013.01)

(58) Field of Classification Search

USPC ..... 220/908, 661, 495.11, 693; 232/1 R, 28, 232/1 E, 1 B, 43.1, 43.4, 43.5; 211/75, 211/81; 16/235

See application file for complete search history.

(56) References Cited

U.S. PATENT DOCUMENTS 541,858 A * 7/1895 Inger ..... A47B 17/03 312/229
814,563 A * 3/1906 Pond ..... B65F 1/10 220/476
1,112,296 A * 9/1914 Kyle ..... A47B 88/06 232/1 R
1,200,477 A * 10/1916 Frantz ..... E05D 11/1007 108/134
3,463,433 A * 8/1969 Coe ..... A47B 57/045 108/108
3,613,566 A * 10/1971 Shapleigh, Jr. ..... B30B 9/3032 100/218
4,216,622 A * 8/1980 Hollenbach ..... A01G 9/1073 47/5.5

(Continued)

FOREIGN PATENT DOCUMENTS

| | | |
|---|---|---|
| CN | 101734456 | 6/2010 |
| CN | 101767702 | 7/2010 |
| CN | 203255584 | 10/2013 |

*Primary Examiner* — J. Gregory Pickett
*Assistant Examiner* — Gideon Weinerth
(74) *Attorney, Agent, or Firm* — Stern & Schurin LLP

(57) ABSTRACT

An improved trash container having a base, a rear partition wall, and a front partition wall hingedly attached to the base to enable the front partition wall to pivot and rotate forward away from the rear partition wall. The trash container further incorporates a bracket member that connects the front partition wall and the rear partition wall, enabling the front partition wall to transition amongst a closed position, an extended position and a releasing position. In a closed position, the base, front partition wall and rear partition wall are connectively aligned and together define an internal cavity for holding a trash bag. In an extended position, the front partition wall is pivoted forward of said base and separated from direct contact with the rear partition wall to enable efficient and hassle-free removal of a filled trash bag from the container.

6 Claims, 7 Drawing Sheets

(56) References Cited

U.S. PATENT DOCUMENTS 5,213,401 A * 5/1993 Hatcher ..... A47B 21/0314 312/208.1
5,282,547 A * 2/1994 Murray ..... A47L 15/4257 134/115 R
5,348,222 A * 9/1994 Patey ..... B65F 1/006 220/262
5,361,978 A * 11/1994 Monroe ..... B65F 1/06 220/908
5,381,921 A * 1/1995 Bray ..... B65F 1/06 220/495.08
5,421,252 A * 6/1995 Reichel ..... B30B 9/3053 100/193
5,603,682 A * 2/1997 Grider ..... A47C 7/40 248/292.14
5,836,470 A * 11/1998 Neelly ..... B65F 1/06 220/4.22
5,901,872 A 5/1999 Zollinhofer
5,984,134 A * 11/1999 Mario ..... B65F 1/06 220/495.11
6,126,257 A * 10/2000 Carpenter ..... G11B 17/225 211/41.12
6,179,151 B1 * 1/2001 Radvansky ..... B65F 1/06 220/4.23
6,193,091 B1 * 2/2001 Olivetti ..... B65F 1/006 220/23.86
6,202,922 B1 * 3/2001 Phillips ..... B65F 1/062 220/908
6,276,553 B1 * 8/2001 Vulcano ..... B65F 1/1468 220/495.06
6,283,321 B1 * 9/2001 Meshorer ..... B65F 1/06 220/4.22
6,334,542 B1 * 1/2002 Hsu ..... B65F 1/1436 220/263
6,386,386 B1 5/2002 George
6,634,611 B1 * 10/2003 Shih ..... F16M 11/10 248/291.1
6,837,467 B2 * 1/2005 Cheng ..... A47B 46/005 108/108
6,962,301 B1 * 11/2005 Chang ..... B02C 18/0007 241/100
7,591,060 B2 9/2009 Shalit
7,703,622 B1 4/2010 Bynoe
8,544,673 B1 10/2013 Polk
8,820,568 B1 9/2014 Antos
8,851,316 B2 * 10/2014 Barrett ..... B65F 1/062 206/389
9,027,779 B2 * 5/2015 Friedman ..... B65F 1/06 220/495.11
D776,893 S * 1/2017 Stauss ..... D34/5
2003/0006237 A1 1/2003 Passantino
2003/0168461 A1 * 9/2003 Richardson ..... B65F 1/02 220/661
2004/0130247 A1 * 7/2004 Model ..... A47B 88/06 312/323
2005/0263734 A1 12/2005 Latona
2006/0261143 A1 * 11/2006 Barbarin ..... B65F 1/06 232/43.1
2009/0242567 A1 * 10/2009 Forbes ..... B65F 1/0006 220/495.08
2009/0243240 A1 * 10/2009 Boustred ..... B62B 1/14 280/47.19
2011/0155748 A1 6/2011 Kipley
2011/0297017 A1 * 12/2011 Brown ..... B30B 9/3053 100/237
2013/0048641 A1 2/2013 Romano
2014/0246439 A1 9/2014 Friedman
2014/0339226 A1 11/2014 Edwards
2016/0194150 A1 * 7/2016 Romano ..... B65F 1/068 220/4.01
2016/0229628 A1 * 8/2016 Chakravarthy ..... B65F 1/062

* cited by examiner

TRASH CONTAINER

FIELD OF INVENTION

The present application relates generally to a container for use in connection with discarding trash. More specifically, the invention relates to an improved trash container that enables the efficient removal of a loaded trash bag located within the improved trash container.

BACKGROUND OF THE INVENTION

There are a multitude of conventional trash containers that exist in the marketplace. For example, in residential and office settings, many trash containers comprise a basic geometric configuration and cavity designed to accommodate a trash bag which is filled over a period of time. Existing trash containers often incorporate a pedal-operated lid that opens when a user steps on a pedal at the base of container, and closes when a user steps off the pedal. Despite the foregoing and other advances in trash container design, these devices fail to provide an effective means to enable a user to remove a filled trash bag from a container without extensive effort or other drawbacks. For example, with regard to trash containers having a basic geometric configuration (e.g., circular, rectangular) or a pedal operated lid, these containers are often subject to unwieldly trash bag removal. In particular, as a trash bag is filled during use, force is applied against the walls of a container, eliminating spaces between the bag and walls of the trash container. As an individual attempts to lift the bag from the trash container, a vacuum is often created inhibiting removal of the trash bag. The suction that is generated causes the trash container to be lifted up with the bag and prevents the bag from being removed from the container without holding the container down or 'dancing' the trash bag out of the container.

Trash containers, such as those disclosed in U.S. Pat. Nos. 8,820,568 and 5,901,872, have dealt with the foregoing and other drawbacks by incorporating a door that opens to permit removal of a trash bag from the side of the container instead of lifting the trash bag out over the open top end. However, providing a trash can with a door that swings open is generally not feasible for compact areas e.g., under a counter cabinet, beside a desk) or in tight corners where trash cans are often placed. Likewise, swinging doors can cause damage to surrounding surfaces and nearby furniture.

Other trash removal systems, such as one disclosed in U.S. Pat. No. 7,591,060, have also addressed some of the drawbacks in trash bag removal from trash cans. That system includes a flexible liner arranged within a trash can. When a trash bag placed within the can is filled to capacity, it forces the flexible liner against the internal wall of the trash can enabling the liner to slide upwardly with the trash bag when the trash bag is removed. Although such a system addresses some of the concerns and drawbacks of prior art trash cans, the system remains unwieldly.

Based on the foregoing, there is an ongoing need to provide a more versatile trash container which addresses the shortcomings of the prior art.

SUMMARY OF THE INVENTION

In view of the deficiencies and drawbacks in the prior art, it is a primary object of the present invention to provide an improved trash container that facilitates removal of trash bags from the top of a container.

It is another object of the present invention to provide an improved trash container having a pivoting partition wall that pivots forward to reduce resistance when removing a trash bag.

It is a further object of the present invention to provide an improved trash container having a pivoting partition wall that pivots a controlled distance within a predetermined range to save space and reduce the unintended damage to nearby surfaces and objects.

Additional objectives of the present invention will be apparent from the disclosure which follows.

In summary, the invention involves an improved trash container having a base, a front partition wall hingedly attached to the base to enable the front partition wall to pivot and rotate forward, and a rear partition wall that defines the rear of the trash container. The trash container further incorporates a bracket member connecting the front partition wall and the rear partition wall, enabling the front partition wall to transition amongst a closed position, an extended position and a releasing position. In a closed position, the base, front partition wall and rear partition wall are connectively aligned and together define an internal cavity for holding a trash bag. In an extended position, the front partition wall is pivoted forward of said base and separated from direct contact with the rear partition wall to enable efficient and hassle-free removal of a filled trash bag from the container.

BRIEF DESCRIPTION OF THE DRAWINGS

The above-described and other advantages and features of the present disclosure will be appreciated and understood by those skilled in the art from the following detailed description and drawings of which

DETAILED DESCRIPTION OF THE INVENTION

Figure 1:
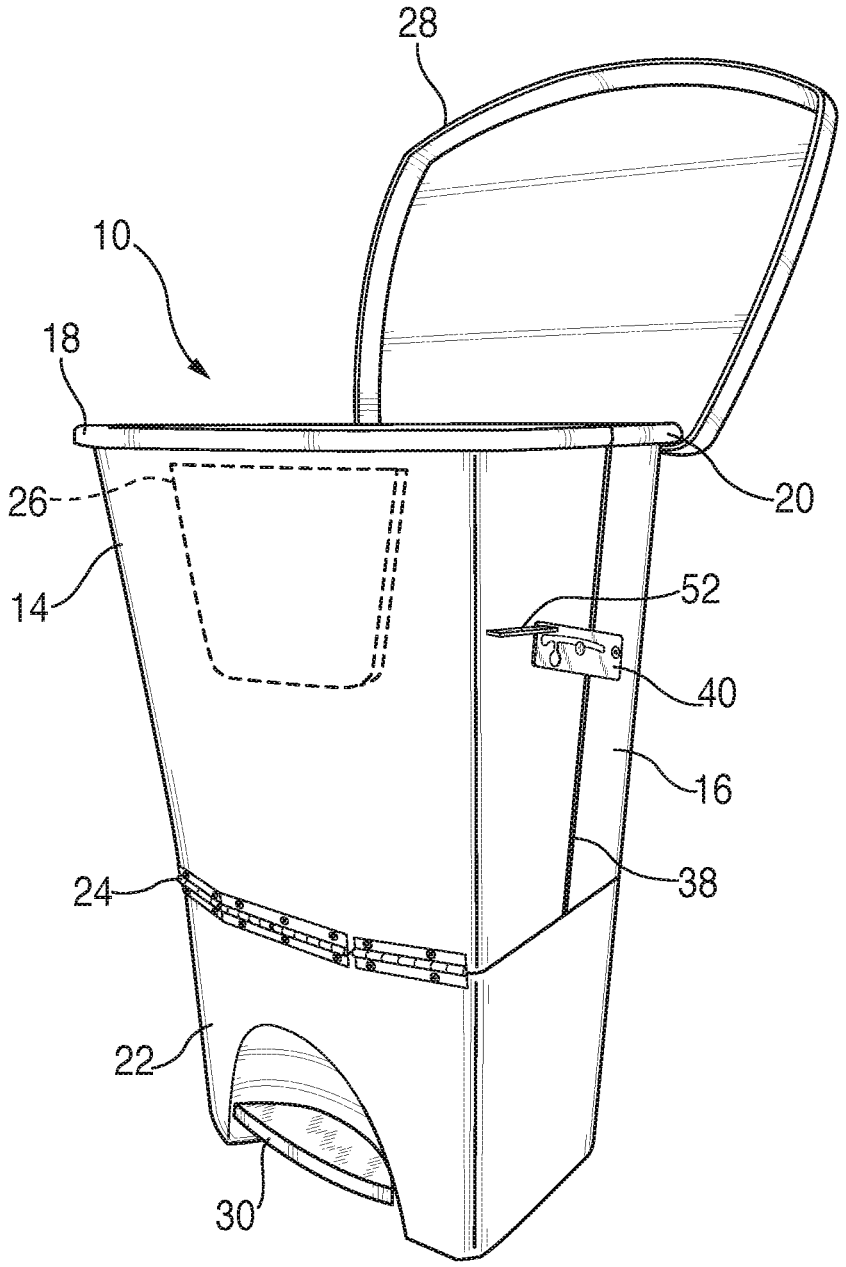
FIG. 1 is a front and left-side perspective view of the improved trash can of the present invention in a closed position.

With reference to FIG. 1 through FIG. 7A, there is shown an improved trash container 10 of the present invention. Trash container 10 comprises an internal cavity defined, in part, by a pair of walled partitions 14, 16, each having an upper rim 18, 20, respectively. Trash container 10 further comprises a base 22 into which internal cavity extends. In a preferred embodiment front partition 14 is secured to base 22 with a trio of hinges 24, 24, 24 positioned on the exterior surfaces of front partition 14 and base 22, which enable front partition 14 to pivot and rotate forward, as shown in FIGS. 3 through 6.

With regard to the construction of trash can 10, it should be appreciated that more or fewer hinges may be utilized in connection with the present invention. Likewise, it should be understood that other attachment members may be utilized that enable front partition 14 to pivot forward in accordance with the present invention. Moreover, in a preferred embodiment, rear partition wall 16 is integrally molded to base 22, thus rendering rear partition wall 16 effectively immobile relative to base 22 and front partition wall 14. Alternatively, trash can 10 may be constructed with a rear partition wall 16 that is either removably attached to base 22 or hingedly attached to base 22, akin to front partition wall 14.

Figure 6:
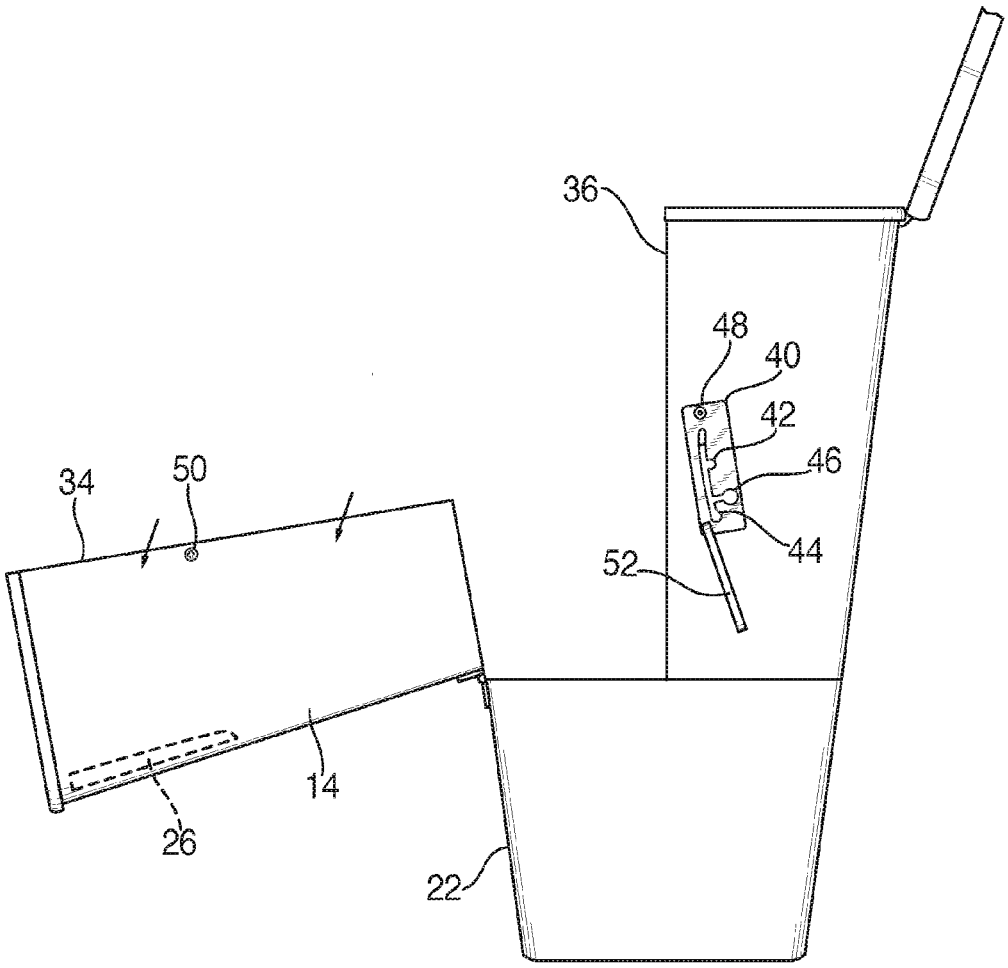
FIG. 6 is a left side elevational view of the improved trash can with the front partition wall fully released.

In a preferred embodiment, front partition 14 incorporates a pocket 26 adapted to hold a plurality of trash bags for use with trash container 10. To prevent trash bags contained within pocket 26 from falling out of pocket 26 when front partition 14 is in a fully released position, as shown in FIG. 6, pocket 26 is provided with a cover or other sealable opening. In a preferred embodiment, trash container 10 also incorporates a lid 28 that is operated by a pedal 30 to open and close the lid.

Figure 2:
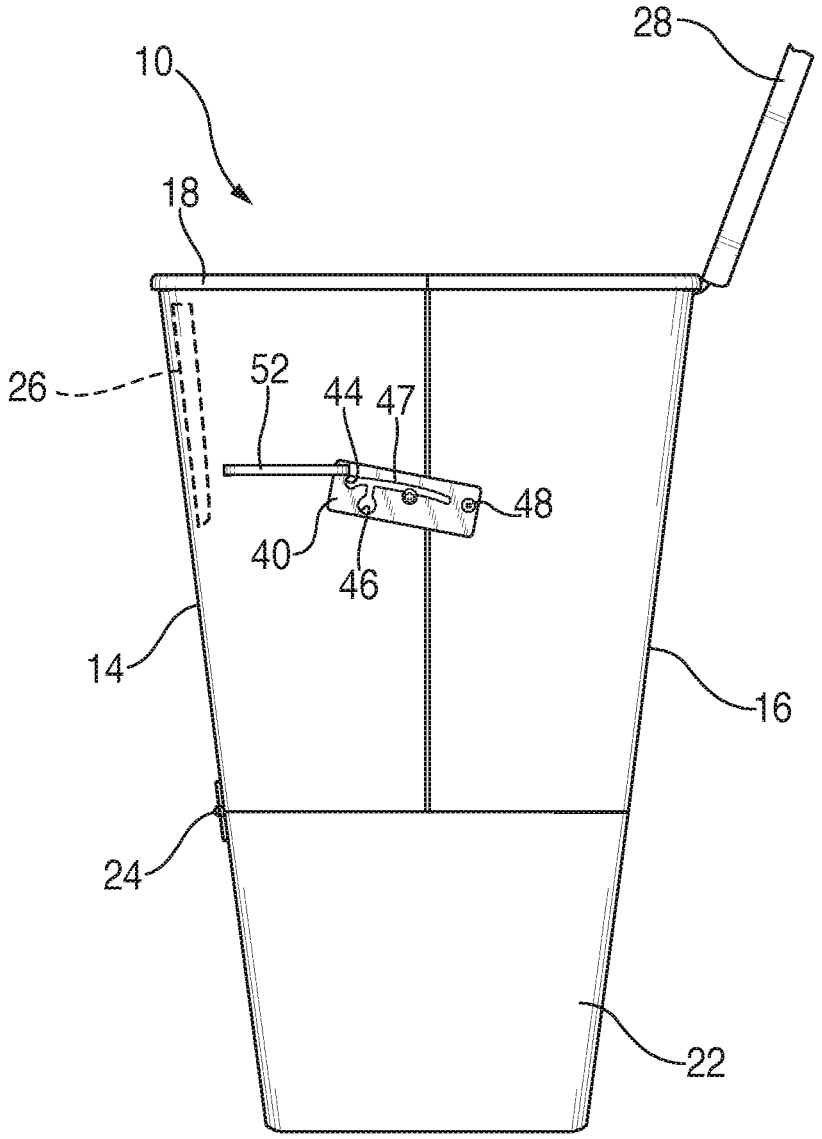
FIG. 2 is a left side elevational view of the improved trash can of the present invention in a closed position.
Figure 7A:
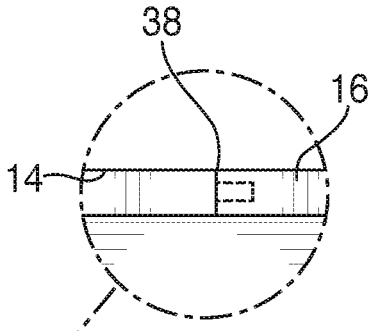
FIG. 7A is a magnified view of the partition walls of the trash can forming a tongue and groove seal or connection.
Figure 7:
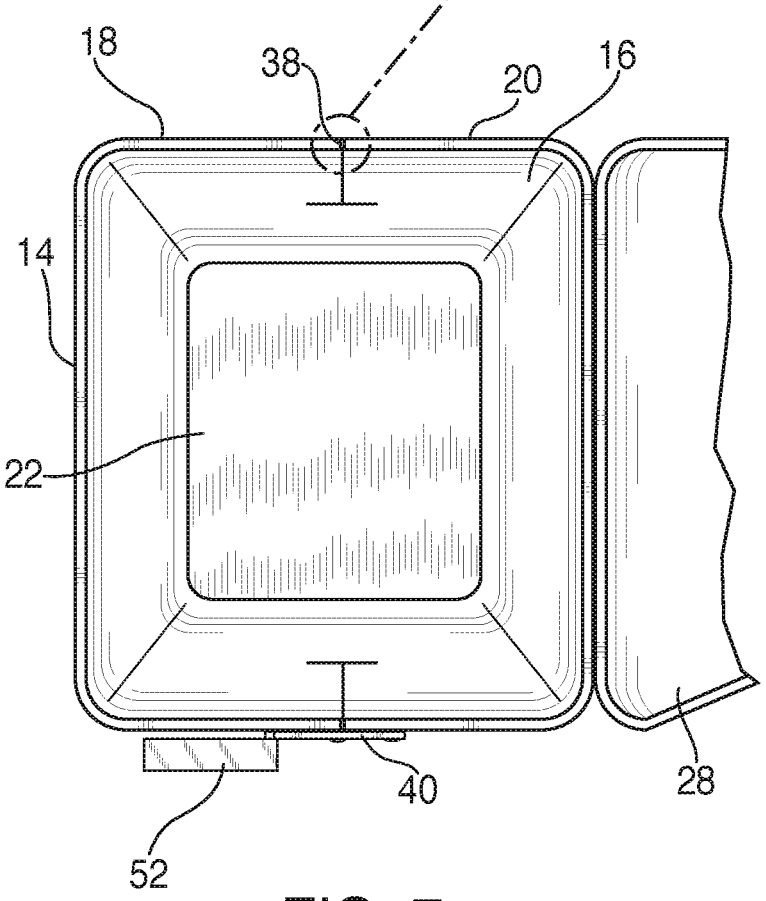
FIG. 7 is a top plan view of the improved trash can of the present invention.

As shown in FIG. 1 and FIG. 2, trash can 10 is in a closed position. When trash can 10 is in a closed position, vertical partition edge 34 of front partition 14 and vertical partition edge 36 of rear partition 16 are aligned to form a tongue and groove connection or seal 38, as shown in FIG. 7A. It should be appreciated that vertical partition edges 36, 38 may be angled somewhat such that edges 36, 38 do not form a perpendicular angle when each meets base 22. Connection or seal 38 provides added stability when trash can 10 is in a closed position by securing sides 40, 40 of front partition 14 to rear partition 16 while the bottom of the front partition 14 is secured to base 22.

A preferred embodiment of trash can 10 incorporates a 3-way or triple recessed bracket member 40 positioned on either side of trash can 10 that enables front partition 14 to pivot a controlled distance forward. While a preferred embodiment incorporates two bracket members, it should be appreciated that a single bracket may be sufficient. Bracket member 40 comprises a first or closed position recess or slot 42, a second or extended position recess or slot 44 and a third or releasing position recess or slot 46. Connecting first slot 42, second slot 44 and third slot 46 is a channel network 47. In a preferred embodiment, the pivoting range of front partition 14 is defined by the distance between closed position slot 42 and extended position slot 44, wherein pivoting movement of front partition 14 is limited by bracket member 40 when bracket member 40 is engaged to front partition 14.

Referring again to FIG. 1 and FIG. 2, bracket member 40 is secured to rear partition 16 with bolt 48. Preferably, bracket member 40 is secured in a manner thud enables bracket member to rotate or pivot about bolt 48 when force is applied to bracket member 40 by a user. In a closed position, a dowel or pin 50—preferably with an enlarged head and narrower shaft—is positioned and secured in closed position slot 42 of bracket member 40. In a preferred embodiment, the relative dimensions and positioning of closed position slot 42 of bracket member 40 and pin 50 produce an audible 'click' and snap fasten when bracket member 40 is manually lifted upward against pin 50 and secured in a closed position. To release bracket member 40 and transition trash can 10 and partition wall 14 into a different position, sufficient downward force is applied by a user to position pin 50 in channel 47. Optionally, an elongated handle 52 is applied to bracket member to enable a user to more easily manipulate the position of a bracket member and to transition between a closed position, extended position and releasing position.

Figure 3:
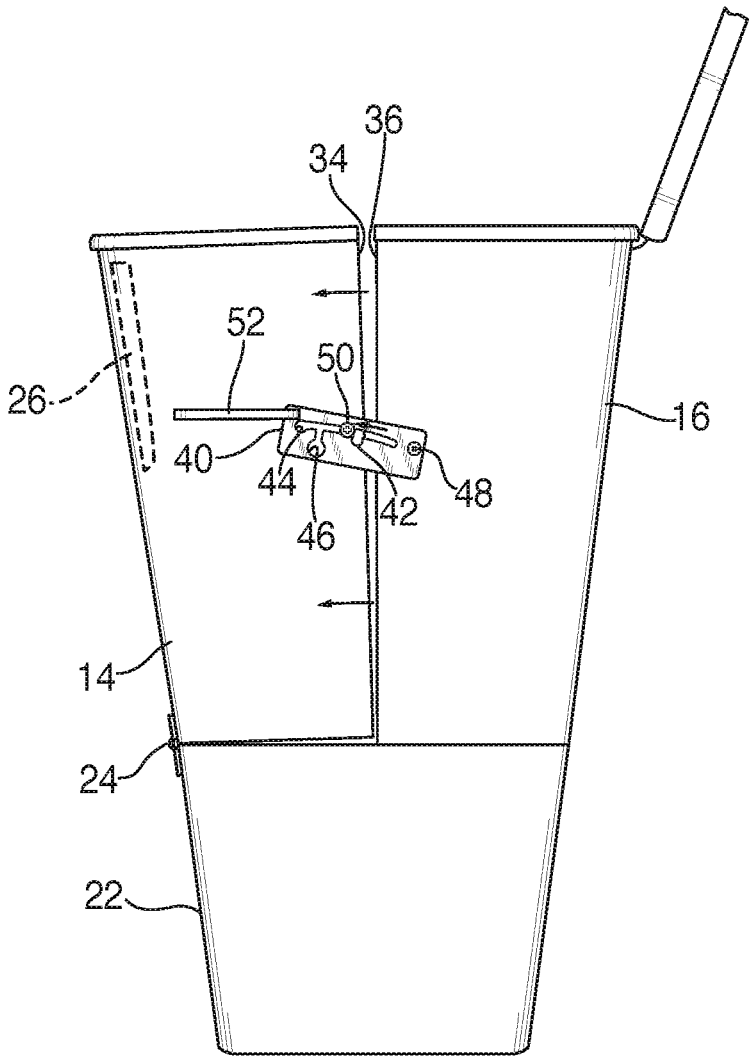
FIG. 3 is a left side elevational view of the improved trash can with a front partition wall pivoting open towards an extended pivoting position.
Figure 4:
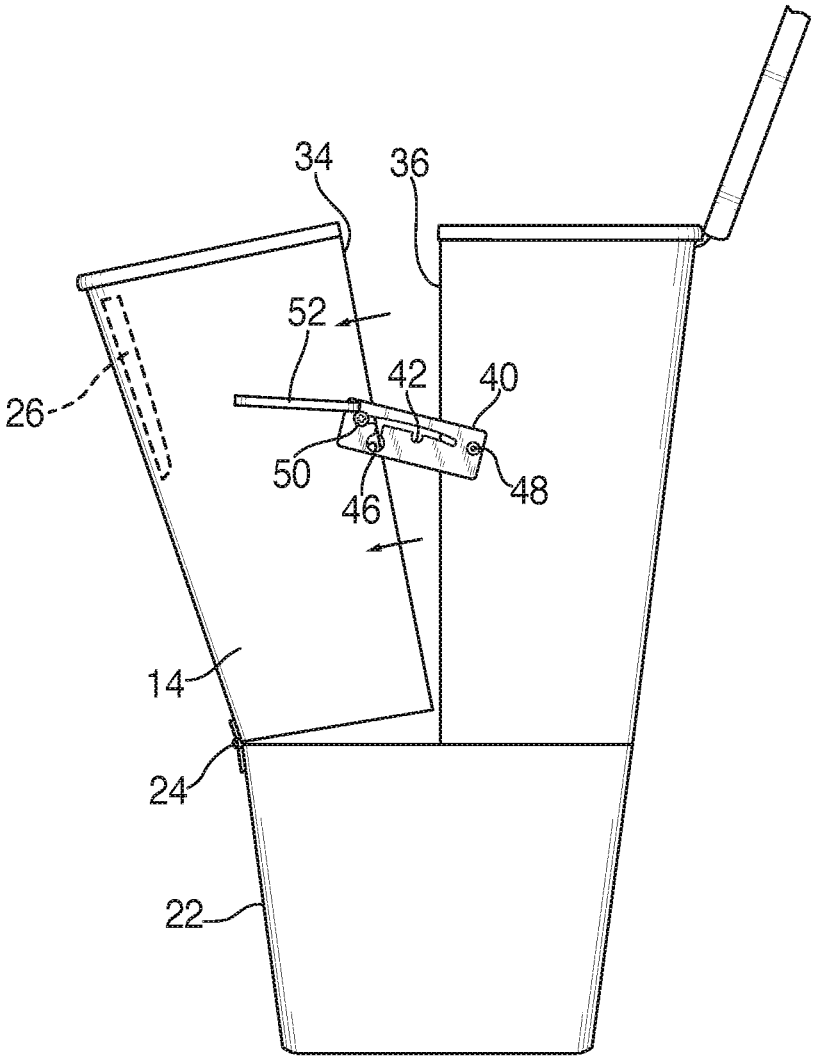
FIG. 4 is a left side elevational view of the improved trash can with a front partition wall in an extended pivoting position.
Figure 5:
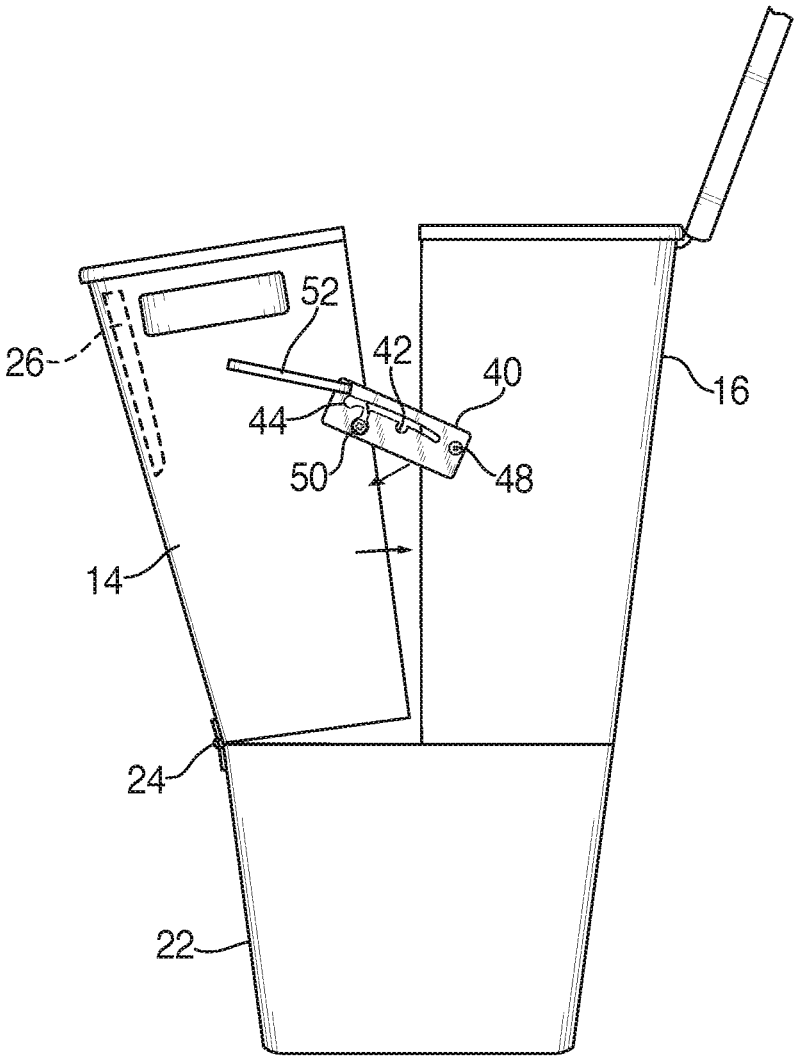
FIG. 5 is a left side elevational view of the improved trash can with the front partition wall and fastening module in a releasing position.

As shown in FIG. 3, pin 50 moves forward along channel 47 as front partition 14 pivots forward. At this point, a user may elect to continue to pivot front partition 14 forward to a fully extended position, as shown in FIG. 4, or to a releasing position, as shown in FIG. 5. When trash can 10 is in an extended position, pin 50 is positioned in second slot 44. Optionally, bracket member 40 and pin 50 also produce an audible 'click' when entering the extended position. When trash can 10 is in an extended position as shown in FIG. 4, front partition 14 pivots approximately 10-40 degrees forward. It should be appreciated that the pivoting range can be further extended or further limited by the length of channel 47 which defines a distance between first slot 42 and second slot 44. When trash can 10 is in an extended position, the separation that is produced between front partition 14 and trash bag reduces or eliminates any suction that would otherwise inhibit the removal of a filled trash bag from trash can 10. By the same token, by pivoting front partition 14 forward, the contents of trash bag are provided with additional space within which to settle which further facilitates removal of the trash bag.

As shown in FIG. 5, trash can 10 is in a releasing position when pin 50 is positioned in third slot 46. Placing trash can 10 in a releasing position enables front partition 14 to pivot forward, as shown in FIG. 6, unrestricted by bracket member 40. Restriction on the degrees of rotation is limited by hinges 24 (or the ground). By enabling front partition 14 to rotate forward, a user may more easily access that portion of internal cavity defined within base 22 for cleaning or related objectives. In a preferred embodiment, the cavity defined within base 22 is at least 2-6 inches in height to accommodate any accumulation of liquid (or other refuse) that may exit from a trash bag if punctured.

In a preferred embodiment, third slot 46 defines a space that is large enough to accommodate the head of pin 50 to enable pin 50 to freely pass through the third slot of bracket member 40. By contrast, first slot 42, second slot 44 and channel 47 define a space large enough to accommodate the shaft of pin 50, but which is otherwise sized to prevent the bracket member 40 from being lifted over the head of pin 50.

In another preferred embodiment of the present invention, trash can 10 may incorporate, in conjunction with or instead of bracket member 40, a male and female clip fastener or buckle that keeps improved trash can 10 in a closed position. In such an embodiment, a male buckle end is positioned on one partition wall and a female buckle end is positioned on the other partition wall. When buckle ends are released from one another, front partition is permitted to pivot open as illustrated.

The accompanying drawings only illustrate a single embodiment of an improved trash container, its constituent parts, and method of use. However, other types and styles are possible, and the drawings are not intended to be limiting in that regard. Thus, although the description above and accompanying drawings contains much specificity, the details provided should not be construed as limiting the scope of the embodiment(s) but merely as providing illustrations of some of the presently preferred embodiment(s). The drawings and the description are not to be taken as restrictive on the scope of the embodiment(s) and are understood as broad and general teachings in accordance with the present invention. While the present embodiment(s)

of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention. It should also be noted that the terms "first," "second" and similar terms may be used herein to modify various elements. These modifiers do not imply a spatial, sequential, or hierarchical order to the modified elements unless specifically stated.

The invention claimed is:

1. An improved trash container comprising:

a base;

a front partition wall hingedly attached to said base and comprising a guiding pin;

a rear partition wall; and a pivotably attached bracket member located on said rear wall connecting said front partition wall and said rear partition wall, said bracket member comprising a handle and a closed position slot, an extended position slot and a releasing position slot;

wherein said guiding pin transitions between said a closed position slot when said front partition wall is in a closed position, an extended position slot when said front partition wall is in an extended position, and a releasing position slot when said front partition wall is in a releasing position;

wherein said rear partition wall and said front partition wall are positioned atop said base and are connectively aligned to form an internal cavity when said front partition wall is in a closed position, said internal cavity adapted to accommodate a standard trash bag; and wherein said front partition wall is pivoted forward of said base and separated from direct contact with said rear partition wall when said front partition wall is in an extended position.

2. The improved trash container of claim 1, said bracket member comprising a curved channel connecting said closed position slot and said extended position slot to enable said pin to transition between said closed position slot when said front partition wall is in a closed position and said extended position slot when said front partition wall is in an extended position.

3. An improved trash container comprising:

a base;

a front partition wall hingedly attached to said base;

a rear partition wall; and a bracket member connecting said front partition wall and said rear partition wall, said bracket member comprising a handle and a closed position slot, an extended position slot and a releasing position slot, and a guiding pin that transitions between said a closed position slot when said front partition wall is in a closed position, an extended position slot when said front partition wall is in an extended position, and a releasing position slot when said front partition wall is in a releasing position;

wherein said handle facilitates snap fastening of said guiding pin and unfastening of said bracket from said guiding pin;

wherein said rear partition wall and said front partition wall are positioned atop said base and are connectively aligned to form an internal cavity when said front partition wall is in a closed position, said internal cavity adapted to accommodate a standard trash bag;

wherein said front partition wall is pivoted forward of said base and separated from direct contact with said rear partition wall when said front partition wall is in an extended position; and wherein said bracket member further comprises a curved channel connecting said closed position slot and said extended position slot to enable said guiding pin to transition between said closed position slot when said front partition wall is in a closed position and said extended position slot when said front partition wall is in an extended position.

4. The improved trash container of claim 1, said front partition wall and said rear partition wall forming a seal when said front partition wall is in a closed position.

5. The improved trash container of claim 4, said seal being a tongue and groove seal.

6. The improved trash container of claim 5, wherein said rear partition wall is integrally molded to said base.

* * * * *